US010950963B2

(12) United States Patent
Veihl et al.

(10) Patent No.: US 10,950,963 B2
(45) Date of Patent: Mar. 16, 2021

(54) RIBBON CABLE CONNECTOR, CONNECTOR ASSEMBLY AND USE OF A CONNECTOR

(71) Applicant: TE Connectivity Germany GmbH, Bensheim (DE)

(72) Inventors: Maximilian Veihl, Seeheim-Jugenheim (DE); Christoph Kosmalski, Darmstadt (DE); Michael Schall, Heppenheim/Sonderbach (DE); Robert Stab, Mannheim (DE); Zoran Stjepanovic, Darmstadt (DE); Marcel Baltes, Floersheim (DE); Willi Dietrich, Ober-Ramstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/415,188

(22) Filed: May 17, 2019

(65) Prior Publication Data

US 2019/0356072 A1 Nov. 21, 2019

(30) Foreign Application Priority Data

May 17, 2018 (DE) ..... 102018207794.0

(51) Int. Cl.
*H01R 12/77* (2011.01)

(52) U.S. Cl.
CPC ..... *H01R 12/778* (2013.01); *H01R 12/771* (2013.01)

(58) Field of Classification Search
CPC .... H01R 12/778; H01R 12/771; H01R 12/77; H01R 12/78
USPC ..... 439/492
See application file for complete search history.

(56) References Cited

U.S. PATENT DOCUMENTS 4,561,714 A * 12/1985 Byczek ..... H01R 12/68 439/408
6,364,691 B1 * 4/2002 Hio ..... H01R 12/68 439/422
6,375,492 B1 * 4/2002 Hio ..... H01R 12/68 439/422
6,746,269 B1 * 6/2004 Casses ..... H01R 4/2495 439/422
7,186,151 B2 * 3/2007 Komiyama ..... H01R 13/514 439/467

(Continued)

FOREIGN PATENT DOCUMENTS

DE 19927300 A1 12/2000
EP 0185153 A1 9/1985

(Continued)

OTHER PUBLICATIONS

Extended European Search Report, European Patent Application No. 19174107.3, dated Oct. 1, 2019, 9 pages.

(Continued)

*Primary Examiner* — Harshad C Patel
(74) *Attorney, Agent, or Firm* — Barley Snyder

(57) ABSTRACT

A ribbon cable connector for attachment to an end of a ribbon cable comprises a plurality of contact element receptacles adapted to receive a plurality of contact elements. A pair of adjacent contact element receptacles is separated from one another.

6 Claims, 4 Drawing Sheets

(56) References Cited

U.S. PATENT DOCUMENTS

| | | | | |
|---|---|---|---|---|
| 7,462,062 | B2 * | 12/2008 | Kumakura | H01R 4/182 439/422 |
| 7,581,979 | B2 * | 9/2009 | Kumakura | H01R 4/185 174/117 FF |
| 10,431,906 | B1 * | 10/2019 | Reed | H01R 4/62 |
| 2001/0027056 | A1 * | 10/2001 | Sawayanagi | H01R 12/68 439/492 |
| 2005/0266724 | A1 * | 12/2005 | McCreery | H01R 12/675 439/492 |
| 2006/0105622 | A1 * | 5/2006 | Nakano | H01R 12/771 439/495 |
| 2007/0077807 | A1 * | 4/2007 | Kumakura | H01R 43/048 439/422 |
| 2007/0111613 | A1 | 5/2007 | Kumakura | |
| 2007/0264864 | A1 * | 11/2007 | Andre | H01R 12/69 439/492 |
| 2012/0100750 | A1 * | 4/2012 | Nomura | H01R 12/613 439/492 |
| 2018/0019548 | A1 | 1/2018 | Maesoba et al. | |

FOREIGN PATENT DOCUMENTS

| | | | |
|---|---|---|---|
| JP | 2001-210146 | A | 8/2001 |
| JP | 2002-334617 | A | 11/2002 |
| JP | 2003-203699 | A | 7/2003 |
| JP | 2015-135754 | A | 7/2015 |

OTHER PUBLICATIONS

German Office Action, dated Mar. 10, 2020, App No. 102018207794.0, 7 pages.

EPO Communication, dated Dec. 21, 2020, 8 pages.

* cited by examiner

RIBBON CABLE CONNECTOR, CONNECTOR ASSEMBLY AND USE OF A CONNECTOR

CROSS-REFERENCE TO RELATED APPLICATION

This application claims the benefit of the filing date under 35 U.S.C. § 119(a)-(d) of German Patent Application No. 102018207794.0, filed on May 17, 2018.

FIELD OF THE INVENTION

The present invention relates to a ribbon cable connector and, more particularly, to a ribbon cable connector attached to an end of a ribbon cable.

BACKGROUND

In a ribbon cable, several conductors run parallel to one another in a joint insulating casing. Ribbon cables are often used for the transmission of signals. In this case, they are also attached to ribbon cable connectors. In ribbon cable connectors, an undesired transmission of signals between contact element receptacles can occur through the flow of current.

SUMMARY

A ribbon cable connector for attachment to an end of a ribbon cable comprises a plurality of contact element receptacles adapted to receive a plurality of contact elements. A pair of adjacent contact element receptacles are separated from one another.

BRIEF DESCRIPTION OF THE DRAWINGS

The invention will now be described by way of example with reference to the accompanying Figures, of which:

FIG. 1 is a perspective view of a connector assembly according to an embodiment prior to plugging-in;

DETAILED DESCRIPTION OF THE EMBODIMENT(S)

Figure 1:
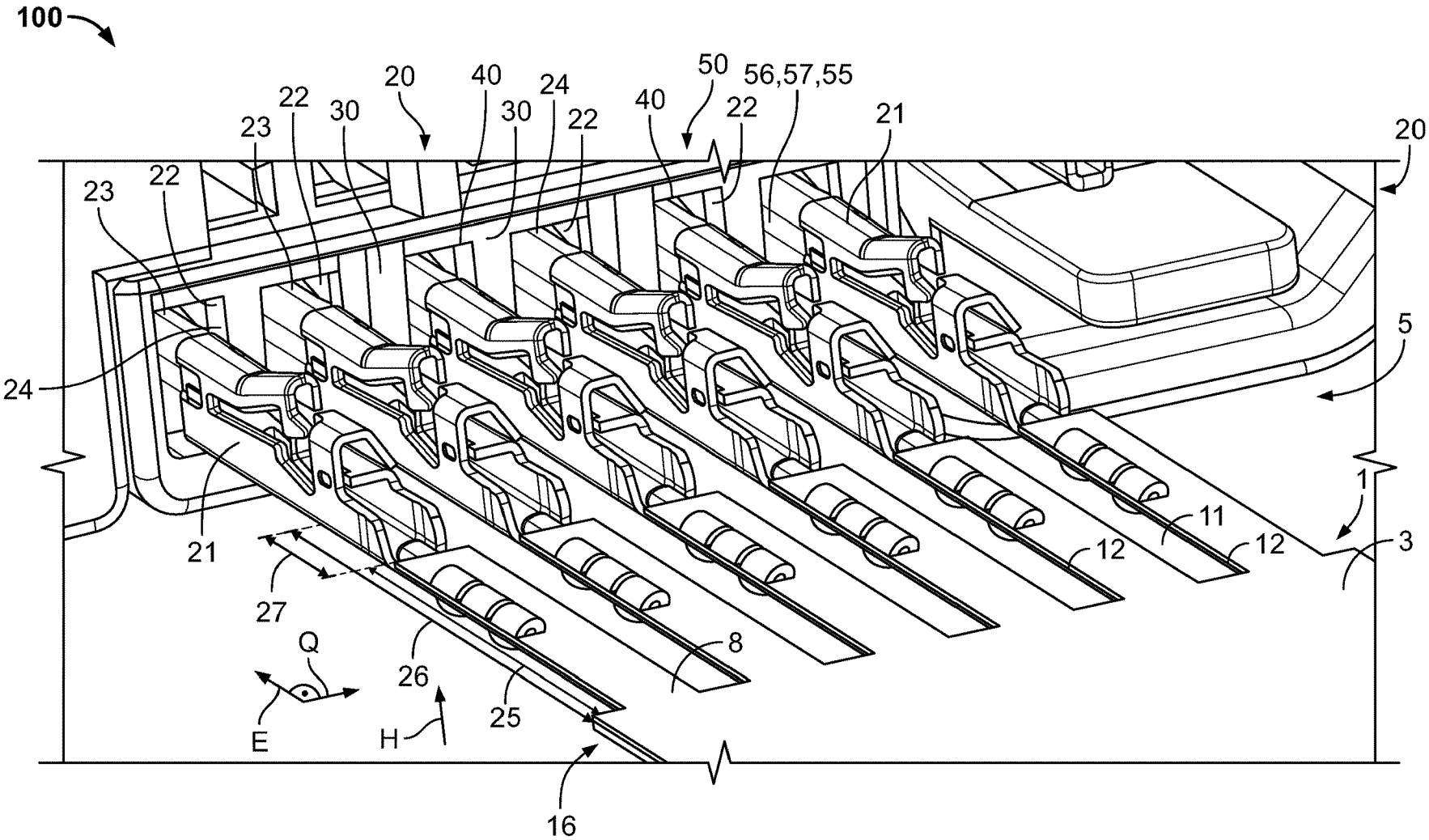

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art. The embodiments described herein are each independent of one another and can be combined with one another as desired, depending on necessity in a specific application.

Figure 2:
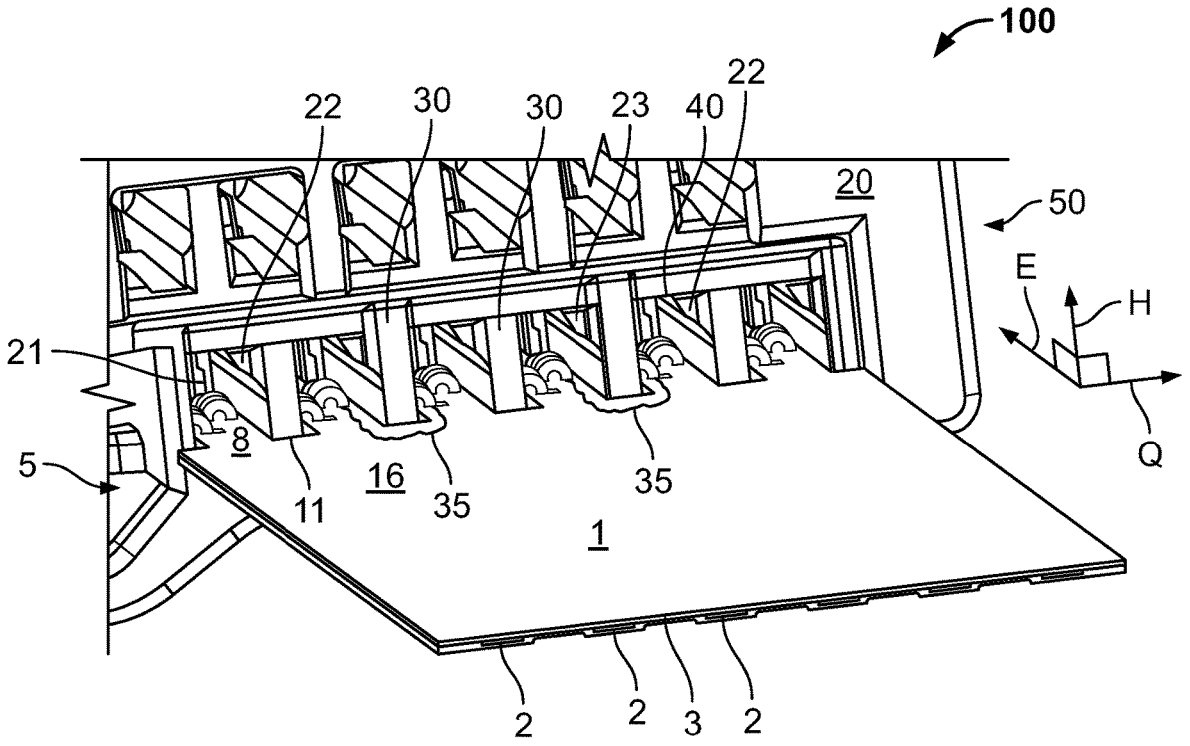
FIG. 2 is a perspective view of the connector assembly of FIG. 1 in a plugged-together state.
Figure 3:
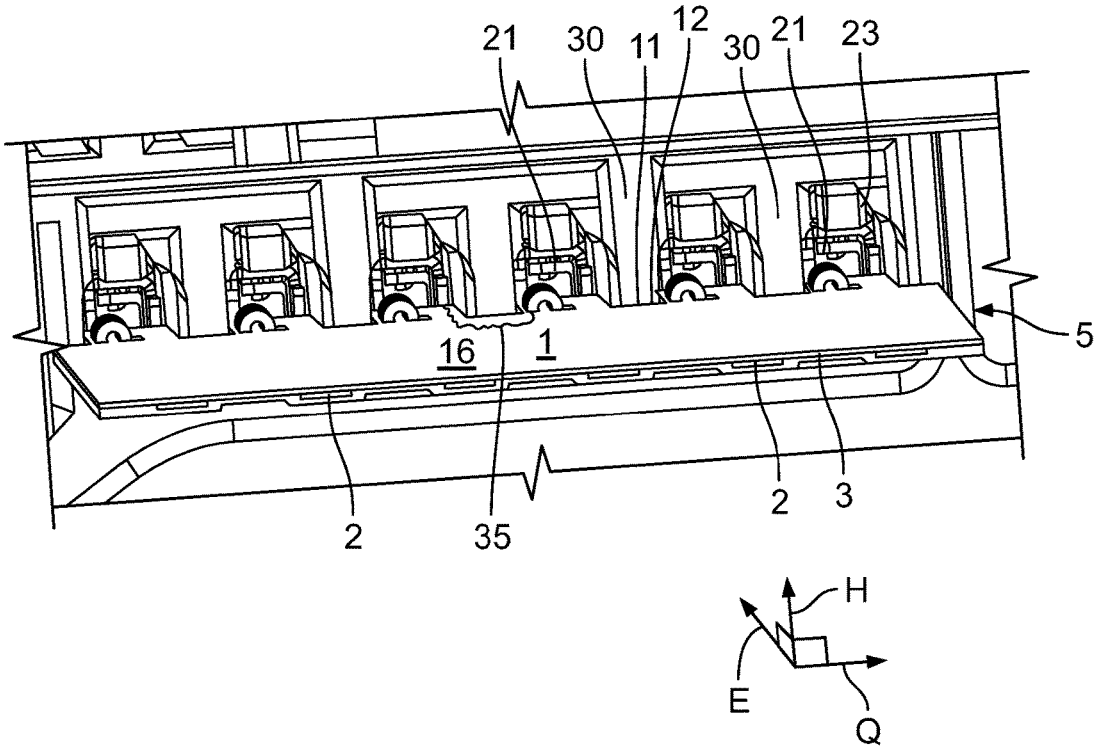
FIG. 3 is a perspective view of the connector assembly of FIG. 1 in the plugged-together state.

A connector assembly 100 according to an embodiment is shown in FIG. 1 in a state prior to plugging-in and in FIGS. 2 and 3 in a plugged-in state. The connector assembly 100 comprises a ribbon cable connector 20 and a ribbon cable 1.

The ribbon cable connector 20, as shown in FIGS. 1 and 2, has a plurality of contact element receptacles 22, into which a plurality of contact elements 21 arranged at the ribbon cable 1 can be plugged along a plug-in direction E. The contact elements 21 can form pins or sockets, for example, which can be plugged together with corresponding mating elements of a mating connector (not shown).

The individual contact element receptacles 22 are separated from one another by walls 30, as shown in FIGS. 1-3. The walls 30 prevent signals from migrating from one contact element 21 to the next contact element 21. Such a disruption occurs above all through creepage distances 35 between the individual contact elements 21, shown in FIGS. 2 and 3, along which electric currents flow. As a result of the separation by the walls 30, these creepage distances 35 are lengthened, which means that, in use, no current can flow and an undesired transmission of signals is prevented.

As shown in FIGS. 1-3, the contact element receptacles 22 are configured as shafts 23 extending with an approximately unchanging cross-section along the plug-in direction E. The shaft walls 24 form the walls 30. The walls 30 extend at least up to plug-in apertures 40 of the contact element receptacles 22. Some of the walls 30 extend further up to a wire-side end 50 of the ribbon cable connector 20 and, as a result, further lengthen the creepage distances 35. In an embodiment, the contact element receptacles 22 are separated from one another along a total extend of the contact element receptacle 22 in the plug-in direction E.

The ribbon cable connector 20, as shown in FIG. 1, has a plurality of insulating elements 55 at the wire-side end 50. The insulating element 55 is configured as a protrusion 56 or a protruding wall 57 and further increases the creepage distance 35. The insulating elements 55 separate the conductors 2 against the plug-in direction E beyond the contact element receptacles 22.

The ribbon cable 1, as shown in FIGS. 1-3, has a plurality of conductors 2 embedded in an insulating element 3 which acts as a carrier and also insulates the conductors 2 from one another and outwardly. At a connector-side end 5, the contact elements 21 are attached to the conductors 2. In order to have space for the walls 30, there are gaps 11 at the connector-side end 5, so that the conductors 2 are individualized at the wire-side end 5 but are at least partly insulated. The insulation at these locations is obtained from the remainder of an insulating casing 8 which has not been removed. The gaps 11 can be produced, for example, by stamping or cutting out with a blade. Other methods, such as removal by melting, for instance by a laser, can also be used.

In the embodiment shown in FIG. 1, an edge 12 of the gap 11 surrounds the gap 11 and is rectangular with corners. Such a configuration can be particularly easy to produce. In another embodiment, the edge 12 can also run smoothly so that no corners are present, as a result of which the risk of cracks arising at the corners is reduced.

The conductors 2 can be stripped at an outermost end, in order to produce a good electrical contact to the contact elements 21. The insulation can still be present in other regions, for example in regions which are crimped with the contact elements 21, but can be at least partly broken up during the crimping process, for example. The insulations arranged around the conductors 2 can be continuations of the insulation of the ribbon cable 1.

In the plugged-together state shown in FIGS. 2 and 3, the walls 30 of the ribbon cable connector 20 extend into the gaps 11 and, as a result, lengthen the creepage distances 35 and the air gaps between the contact elements 21. The incisions 12 or gaps 11 can have a depth 25 which corresponds to at least the difference between a plug-in depth 26, along which the conductor 2 is plugged in the ribbon cable connector 20, and a contact length 27, along which the conductor 2 is stripped. The gap 11 extends between a stripped section and a jointly coated section 16 of the conductors 2.

Figure 4:
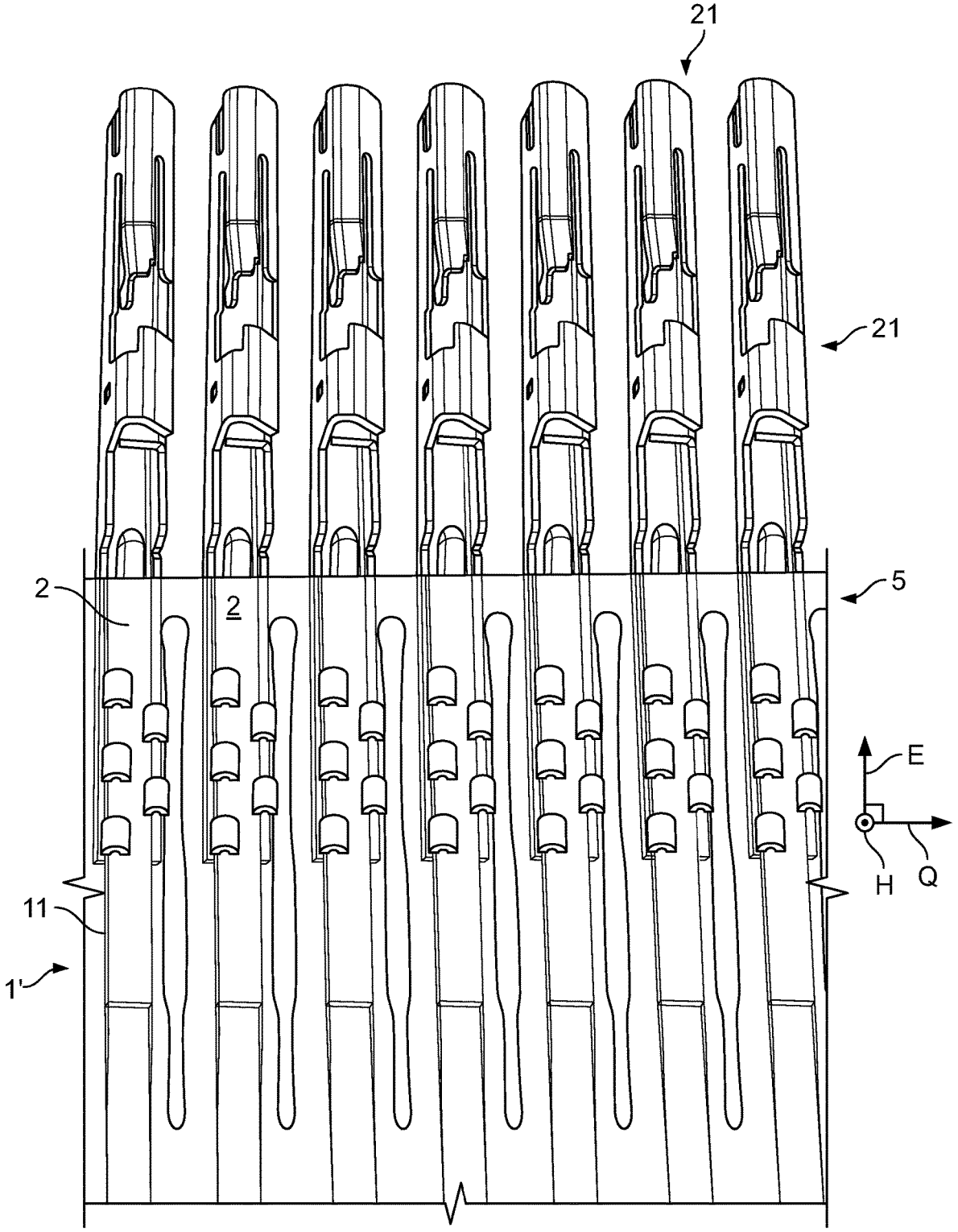
FIG. 4 is a perspective view of a ribbon cable in a pre-mounting state according to an embodiment.
Figure 5:
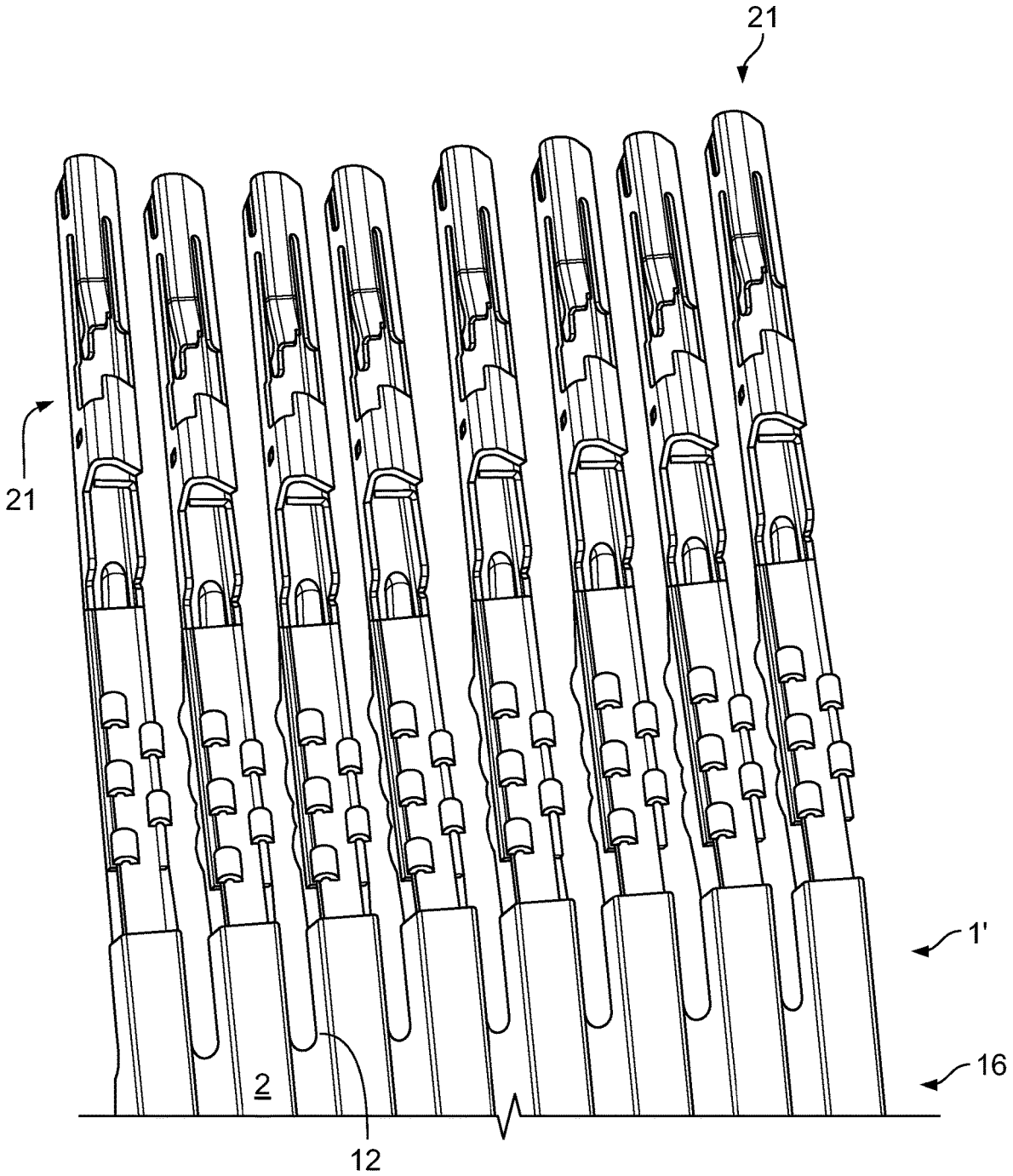
FIG. 5 is a perspective view of the ribbon cable of FIG. 4 in a split state.

A ribbon cable 1' according to another embodiment is shown in FIGS. 4 and 5. The ribbon cable 1' has, between the conductors 2, gaps 11 which are still closed at the connector-side end 5, in order to attain sufficient stability. The contact elements 21 are attached to the conductors 2 by crimping. The connections at the connector-side end 5 are then split, so that, as shown in FIG. 5, the individual conductors 2 are individualized and partly insulated. As a result, they can be inserted into the contact element receptacles 22, with the walls 30 being situated in the gaps 11 in the mounted state. In the embodiment according to FIGS. 4 and 5, the edge 12 of the gaps 11 is rounded particularly in a rear region, so that the risk of crack formation is smaller.

What is claimed is:

1. A ribbon cable connector for attachment to an end of a ribbon cable, comprising:

a body defining a wire side end;

a plurality of contact element receptacles formed in the body and adapted to receive a plurality of contact elements in a plug-in direction in which the contact elements are plugged into the contact element receptacles from the wire side end, each contact element receptacle defining a plug-in aperture at a first end thereof, the plug-in aperture defined within the body at first distance in the plug-in direction from the wire side end, each pair of adjacent contact element receptacles are separated from one another by a wall, the wall between each pair of adjacent contact element receptacles extends into one of a plurality of gaps in the ribbon cable disposed between a plurality of conductors of the ribbon cable; and a plurality of insulating elements, each insulating element extending from the wall between each pair of adjacent contact elements and into one of the plurality of the contact element receptacles in a direction transverse to the plug-in direction, a portion of the plurality of insulating elements extending beyond the contact element receptacles in a direction opposite the plug-in direction.

2. The ribbon cable connector of claim 1, wherein the contact element receptacles are separated from one another along a total extent of the contact element receptacles in the plug-in direction.

3. The ribbon cable connector of claim 1, wherein first pairs of the plurality of the contact element receptacles are separated from one another by a wall extending a first distance from a position within the contact element receptacle up to the plug-in aperture.

4. The ribbon cable connector of claim 3, wherein second pairs of the plurality of the contact element receptacles are separated from one another by a wall extending a second distance, greater than the first distance, from a position within the contact element receptacle up to the wire-side end of the connector.

5. The ribbon cable connector of claim 1, wherein the plurality of insulating elements are each a protrusion having a height less than a height of the wall from which it extends.

6. The ribbon cable connector of claim 1, wherein the distance between each of the insulating elements and a respective contact element plugged into a contact element receptacle in the direction transverse to the plug-in direction is less than the distance between the respective contact element and the wall from which the insulating element extends.

* * * * *